US005854959A

United States Patent [19]

Mirabella, Jr.

[11] Patent Number: 5,854,959

[45] Date of Patent: Dec. 29, 1998

[54] ADAPTIVE FUSER CONTROL FOR 180 CPM

[75] Inventor: Charles J. Mirabella, Jr., Rochester, N.Y.

[73] Assignee: Xerox Corporation, Stamford, Conn.

[21] Appl. No.: 749,308

[22] Filed: Nov. 14, 1996

[51] Int. Cl.[6] ..... G03G 15/20

[52] U.S. Cl. ..... 399/69; 219/216

[58] Field of Search ..... 219/216; 399/69, 399/70, 320, 330

[56] References Cited

U.S. PATENT DOCUMENTS

| | | | |
|---|---|---|---|
| 3,268,351 | 8/1966 | Van Dora . | |
| 3,937,921 | 2/1976 | Furuichi et al. | 219/494 |
| 3,945,726 | 3/1976 | Ito et al. . | |
| 4,019,024 | 4/1977 | Namiki . | |
| 4,231,653 | 11/1980 | Nagahara et al. . | |
| 4,315,682 | 2/1982 | Parzanici . | |
| 4,318,612 | 3/1982 | Brannan et al. | 399/70 |
| 4,425,494 | 1/1984 | Enomoto et al. | 219/216 |
| 4,549,803 | 10/1985 | Ohno et al. . | |
| 4,551,007 | 11/1985 | Elter . | |
| 4,595,274 | 6/1986 | Sakurai . | |
| 4,618,240 | 10/1986 | Sakurai et al. . | |
| 4,653,897 | 3/1987 | Fromm . | |
| 4,920,250 | 4/1990 | Urban | 219/216 |
| 4,963,943 | 10/1990 | Tamarz . | |
| 5,019,693 | 5/1991 | Tamary | 219/471 |
| 5,051,780 | 9/1991 | Stelter et al. . | |
| 5,124,756 | 6/1992 | Stelter . | |
| 5,141,333 | 8/1992 | Ndebi et al. . | |
| 5,225,874 | 7/1993 | Koh et al. | 399/69 |
| 5,247,336 | 9/1993 | Mills, III . | |
| 5,343,019 | 8/1994 | Nashida et al. | 219/216 |
| 5,436,430 | 7/1995 | Baruch et al. | 219/216 |

FOREIGN PATENT DOCUMENTS

| | | |
|---|---|---|
| 58-197524 | 11/1983 | Japan . |
| 62-173484 | 7/1987 | Japan . |
| 4-318586 | 11/1992 | Japan . |

*Primary Examiner*—Robert Beatty

[57] ABSTRACT

Image fix level and Input Output Terminal (IOT) faults are minimized. The foregoing are effected by reducing fuser roll temperature sag or droop which can be a problem during the initial portion of a copy run. A heated fuser member is operated at a higher power level during the initial portion of a print cycle. This is effected using an existing controller without modifying the controller's hardware. The foregoing is accomplished by detecting voltages values applied to the fuser member, storing these values corresponding to fuser operating parameters in a LUT, detecting elapsed time from the start of a print cycle, using the operating parameters corresponding to the detected voltage during a portion of the print cycle, and determining the difference between a detected voltage and a predetermined voltage value and using the fusing operating parameter corresponding to this difference during the initial portion of the print cycle in accordance with elapsed time.

20 Claims, 3 Drawing Sheets

ADAPTIVE FUSER CONTROL FOR 180 CPM

BACKGROUND OF THE INVENTION

This invention relates generally to xerographic printing apparatus, and more particularly, it relates to the controlling of a heated roll of a heat and pressure fuser apparatus.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to elevate the temperature of the toner material to a point at which the constituents of the toner material coalesce and become tacky while simultaneously applying pressure. This action causes the toner to flow to some extent into the fibers or pores of support members or otherwise upon the surfaces thereof. Thereafter, as the toner material cools, solidification of the toner material occurs causing the toner material to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll thereby to effect heating of the toner images within the nip.

Roll fusers characteristically loose more temperature than the heating element can give during fusing of the first few prints of a print run thereby causing fix level to be adversely affected and system faults to occur. In order to insure proper image fix levels and to minimize system faults during the fusing of the first few prints, it is necessary to address the phenomena commonly known as droop or sag which can occur at that time.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

A number of references show simplex fusers which include heating lamps in both rollers. The heating lamp in the roller that does not contact the image is generally used to prevent that roller from lowering the temperature of the roller which does contact the image when the rollers are in contact between images. See, for example, U.S. Pat. No. 4,231,653, Nagahara et al, issued Nov. 4, 1980; U.S. Pat. No. 4,549,803, Ohno et al, Oct. 29, 1985; U.S. Pat. No. 4,595, 274, Sakurai, Jun. 17, 1986; U.S. Pat. No. 4,618,240, Sakurai et al, Oct. 21, 1986; U.S. Pat. No. 4,019,024 Namiki, Apr. 19, 1977; U.S. Pat. No. 3,945,726, Ito et al, Mar. 23, 1976 and U.S. Pat. No. 3,268,351, VanDorn, Aug. 23, 1966.

U.S. Pat. No. 4,963,943, issued Oct. 16, 1990 to Tamary discloses a solution to the droop problem that includes carefully controlling the temperature of the fusing apparatus by simulating heat loss in the fuser roller with cool air.

U.S. Patent No. 5,436,430 granted on Jul. 25, 1995 to Baruch et al discloses a fuser for fixing toner images to a receiving sheet includes pressure and fusing rollers which are separated during idle. In response to a run signal, the temperature of the fusing roller is given a boost according to a sensed or estimated temperature of the pressure roller. At other times during both idle and run, the temperature of the fusing roller is controlled by a sensor U.S. Patent No. 5,247,336 granted on Sep. 21, 1993 to Borden H Mills, III, discloses a fusing apparatus for fusing toner images onto a substrate. The fusing apparatus includes a heated first fusing member, a second timing member and a fusing mix formed by the first and second members. A substrate carrying and unfused toner image on a first on a first side thereof is routed through the fusing nip such that the unfused toner image directly faces the heated first member, and the second side thereof directly faces the second fusing member. In order to prevent melting or remelting of a toner image on such second side, the fusing apparatus includes a device for cooling and maintaining the temperature of the second fusing member at a point below the melting temperature of toner particles forming the image on such second side.

U.S. Patent No. 5,141,333 granted on Aug. 25, 1992 to Daniel M. Yasich discloses a device for monitoring the temperature of a moving surface, particularly the outside surface of a heated roller in a toner fusing apparatus including a roller which rolls on the surface as it moves. The roller is virtually entirely made up of two thermocouple materials. Because the materials themselves directly engage the surface being monitored, the device has a fast response to temperature change of the surface.

U.S. Patent No. 5,124,756 granted on Jun. 23, 1992 to Eric C. Stelter discloses a copier or printer that uses the principle of single pass duplexing which produces simplex output at full machine speed and duplex output with a gap of at least one sheet between sheets. It has a duplex fuser that fuses both duplex images simultaneously. The duplex fuser has a first relatively hard roller which contacts the side of receiving sheets carrying simplex images and a soft heated roller which contacts the opposite sides of sheets. The soft roller is heated, in part, by a lamp in its center, and, in part, by heat from the first roller which is passed to the soft roller between duplex sheets. The soft roller therefore runs at a higher temperature for duplex than it does for simplex. The hard roller preferably has a thin elastomeric layer on a metal core and therefore transfers heat to its surface more efficiently and faster than the soft roller.

U.S. Patent No. 5,051,780 granted on Sep. 24, 1991 to Stelter et al discloses an apparatus that forms unfixed toner images on receiving sheets and fixes the images using a fuser having at least one heated roller. A temperature control means for the roller has a run set point and a standby set point. The apparatus monitors the formation of images. If the formation is interrupted, which would result in a skipped sheet at the fuser, set point for the fuser is adjusted toward the standby set point. The invention is particularly usable in a printer in which skip frames develop because a raster image processor is unable to form pages as fast as the printer can print pages.

U.S. Patent No. 5,019,693 granted on May 28, 1991 to Ernest J. Tamary discloses the controlling of the surface temperature of a fusing roller by sensing both the surface temperature and the temperature of a source of heat for said roller. Each temperature is compared to a nominal temperature for each to derive two error signals. The two error signals are combined to give a combined error signal, which is used to control the amount of energy applied to the source. The source can be an internally heated core or heated external roller riding on the fusing surface.

U.S. Patent No. 4,963,943 granted on Oct. 16, 1990 to Ernest J. Tamary discloses a fusing apparatus operable at a desired fusing temperature through a run period when toner images on a receiver or copy sheet are fused, using up a required and first amount of heat, and through a standby period when the apparatus is awaiting a run period. The fusing apparatus includes a device for selectively dissipating, during the standby period, a desired and second amount of heat approximating the required and first amount of heat used up during the run period. The heat dissipating device thus prevents "droop" or a dropping from the desired fusing temperature, by causing heat flow from the apparatus to remain relatively constant during both run and standby periods. Additionally, such dissipation also advantageously cools the apparatus, thereby preventing the occurrence of heat-related fusing defects such as copy curling, blistering, and image offset.

U.S. Patent No. 4,920,250 granted on Apr. 24, 1990 to Carl T. Urban, discloses an apparatus for fusing toner images to suitable substrates or copy sheets of paper includes a self-learning heater that substantially prevents "droop" or drops from a desired setpoint in the fusing temperature of the apparatus. The heater itself has a variable temperature control setpoint, and is connected to means for monitoring temperature variations due to heat lost by the apparatus to the substrates or copy sheets, as well as, to means for varying the temperature control setpoint of the heater in direct response to such monitored temperature variations. The heater as such, is capable of substantially preventing significant variations in the fusing temperature of the apparatus by effectively replacing such heat loss by the fusing apparatus.

U.S. Pat. No. 4,653,897 granted on Mar. 31, 1987 to Paul M. Fromm discloses a heat and pressure fusing apparatus having a thin-walled tubular fuser roll cooperating with a rigid pressure roll to pass copy substrates therebetween with the toner images on the substrates contacting the fuser roll. The rolls are supported in pressure engagement such that the axes are skewed relative to each other to compensate for roll deflection aggravated by hoop deflection of the thin-walled fuser roll. Thermal degradation of the elastomeric conformable coating is reduced by standing by at a low temperature and quickly warming up to run temperature.

U.S. Pat. No. 4,551,007 granted on Nov. 5, 1985 Michael R. Elter to discloses an apparatus in which images on sheets are fused during a copy run. Heat is applied to at least the images on successive sheets advanced, in seriatim, through a fusing device permanently affixing the images to the sheet. The temperature of the fusing device is detected and a signal indicative thereof transmitted. A controller compares the time derivative of the signal received from the detector at initialization of the copy run to a first constant and energize the heater of the fusing device when the first constant is less than the time derivative of the signal. During the copy run, after the time derivative of the signal is less than the first constant, the controller compares the signal received from the detector to a constant and generates an error signal indicative of the difference therebetween to control the heater of the fusing device. After the copy run, the controller compares the time derivative of the signal received from the detector to still another constant and de-energizes the heater of the fusing device when this latter constant is less than the time derivative of the signal. Once the surface temperature of the fusing device returns to the stand-by temperature at the end of the copy run, the controller returns to comparing the signal received from the detector to a constant and generating an error signal indicative of the difference therebetween which regulates the heater thereof.

U.S. Pat. No. 4,315,682 granted on Feb. 16, 1982 to Remo E. Parzanici discloses a fuser roll apparatus in a toner fixing station associated with an electrophotographic or xerographic device for fixing a toner image onto a copy sheet by the application of heat and pressure. The fusing apparatus includes a heated fuser roll and a pair of smaller, spaced backup rolls, each of the backup rolls having a peripheral surface covering of a different elastic modulus from the other. The backup rolls are arranged so as to cooperate with the heated fuser roll to define two fusing nips through which a copy sheet sequentially passes. The downstream roll has the harder peripheral surface covering. As the copy sheet passes through the two nip areas in succession, the downstream backup roll tends to pull against the upstream backup roll. Thus, the copy sheet is tensioned as it passes over the portion of the surface of the heated fuser roll between the two backup rolls.

BRIEF SUMMARY OF THE INVENTION

The present invention is directed to the improvement of image fix level and the minimization of Input Output Terminal (IOT) faults. The foregoing are effected by reducing fuser roll temperature sag or droop which can be a problem during the initial portion of a copy run. Sag or droop occurs when the heated fuser roll gives up more heat than the heating element can supply. Pursuant to the invention, a heater element is operated at a higher power level during the initial portion of a print cycle. This is effected using an existing controller without modifying the controller's hardware.

For the existing hardware, a set of voltages and corresponding operating parameters are stored in a Look Up Table (LUT) in processor memory.

During a steady state portion of a print cycle, the fuser controller is operated according to the parameters found in the LUT. Operation in this manner has the effect of normalizing the heater element input voltage to an average level of 179 VAC which produces an average power level of 2700 watts.

During the initial portion of the print cycle the same LUT is used but in order to boost the average power level of the heater element to about 3000 watts. To compensate for sag, the operating parameters for the detected voltage during this portion of the print cycle correspond to the operating parameters for a voltage lower than the detected voltage. Thus, the LUT is used for controlling the heater element during both portions of the print cycle but different operating parameters are used for the same detected voltage.

DETAILED DESCRIPTION OF THE DRAWING

PREFERRED EMBODIMENT OF THE INVENTION

Reference is now made to the drawings where the showings are for the purpose of illustrating a preferred embodiment of the invention and not for limiting same. The various processing stations employed in the printing machine illustrated in FIG. 3 will be briefly described.

Figure 3:
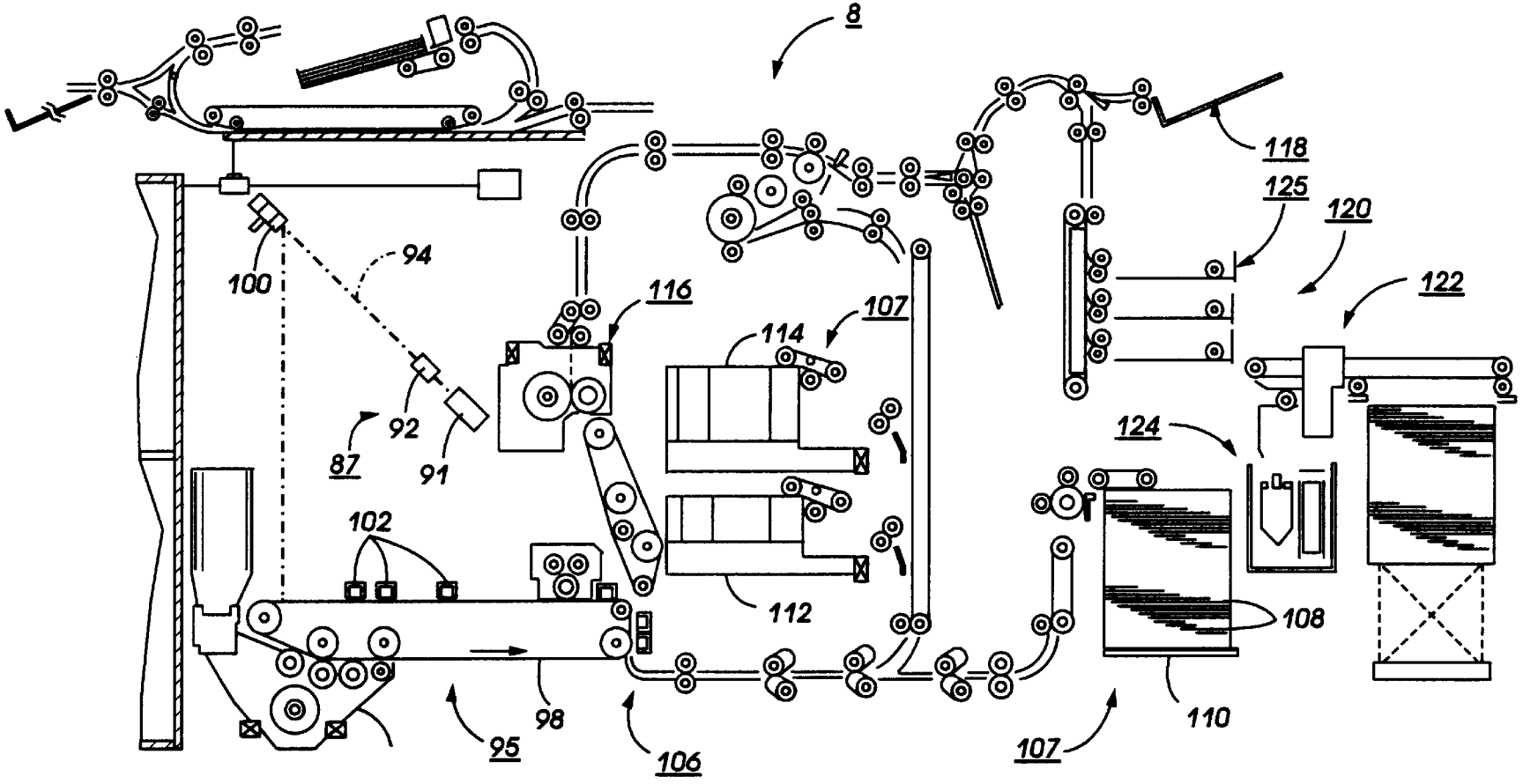
FIG. 3 is a schematic illustration of a printing device in which the heated fuser member of FIG. 1 and the control of FIG. 2 may be utilized.

Referring now to FIG. 3, printer section 8 comprises a laser type printer and for purposes of explanation is separated into a Raster Output Scanner (ROS) section 87, Print Module Section 95, Paper Supply section 107, and Finisher 120. ROS 87 includes a laser 91, one or more beams 94 of which are modulated in accordance with the content of an image signal input by acousto-optic modulator 92 to provide the beams 94. Beams 94 are scanned across a moving photoreceptor 98 of Print Module 95 by the mirrored facets of a rotating polygon 100 to expose two image lines on photoreceptor 98 with each scan and create the latent electrostatic images corresponding to the image signal input to modulator 92. Photoreceptor 98 is uniformly charged by corotrons 102 at a charging station preparatory to exposure by imaging beams 94. The latent electrostatic images are developed by developer 104 and transferred at transfer station 106 to a print media 108 delivered by Paper Supply section 107. Media 108, as will be apparent, may comprise any of a variety of sheet sizes, types, and colors. For transfer, the print media is brought forward in timed registration with the developed image on photoreceptor 98 from either a main paper tray 110 or from auxiliary paper trays 112, or 114. The developed image transferred to the print media 108 is permanently fixed or fused by a heat and pressure roll fuser 116 and the resulting prints discharged to either output tray 118, or to output collating trays in finisher 120. Finisher 120 includes a stitcher 122 for stitching (stapling) the prints together to form books, a thermal binder 124 for adhesively binding the prints into books and a stacker 125. A finisher of this type is disclosed in U.S. Pat. No. 4,828,645 and 4,782,363 whose contents are hereby incorporated by reference.

The heat and pressure roll fuser 116 comprises a Nip Forming Pressure Roll (NFPR) fuser wherein an internally heated fuser roll 10 which is mounted for pressure engagement with a pressure roll (not shown) 20 such that a depression is formed in the pressure roll thereby delineating a fusing nip between the two rolls.

Figure 1:
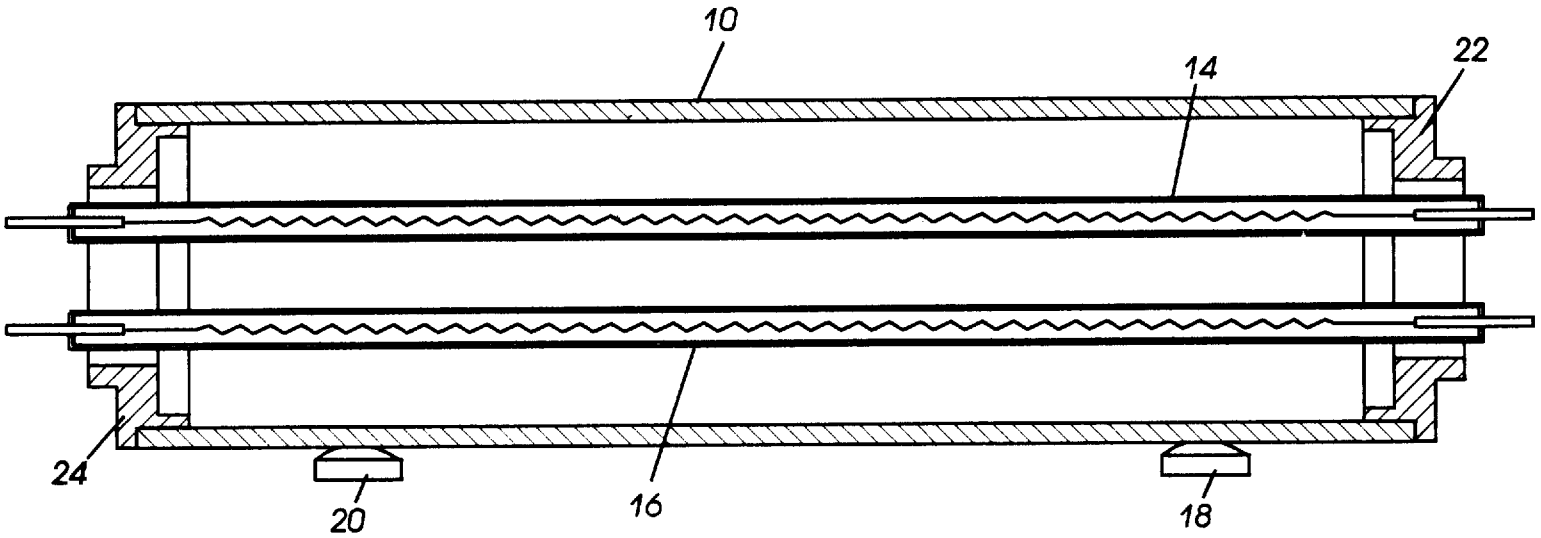
FIG. 1 is a is a plan view of a heated fuser roll.

As illustrated in FIG. 1, the heated fuser roll 10 utilizes two lamps 14 and 16. The roll surface temperature is monitored using two thermistors 18 and 20 mounted approximately 195 degrees, counterclockwise from the fusing nip as viewed in FIG. 1. In an arrangement where the fuser roll and pressure roll are positioned in a side by side orientation, the fuser nip is at approximately the three o'clock position and the thermistors are located at approximately the ten o'clock.

The thermistor 18 is positioned adjacent the inboard end 22 of the fuser roll while the thermistor 20 is positioned adjacent the outboard end 24 thereof. The outboard thermistor is utilized for controlling the surface temperature of the heated fuser roll while the inboard thermistor is used for determining which lamp is activated.

Figure 2:
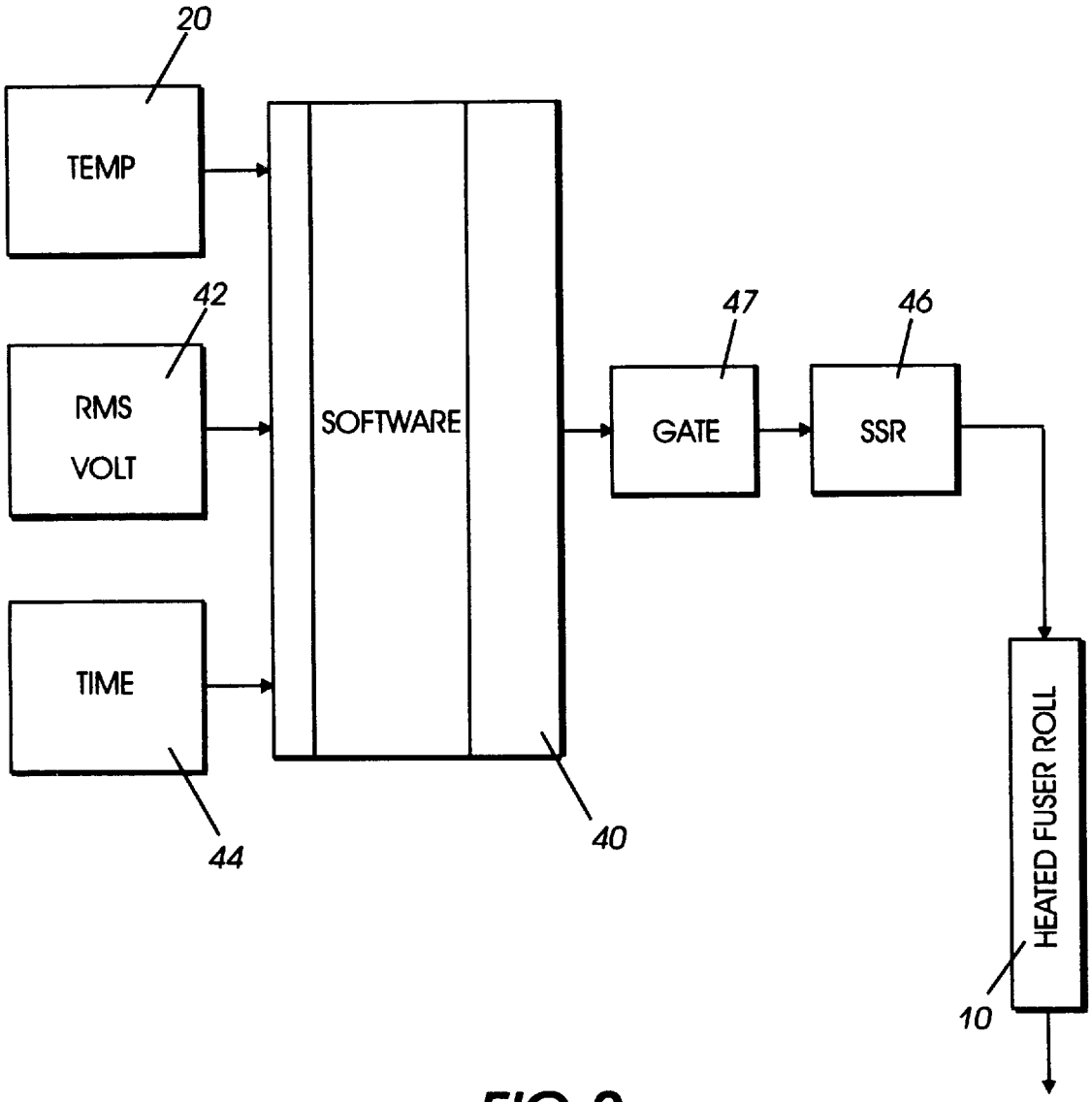
FIG. 2 is a block diagram illustrated a control for the heated fuser member of FIG. 1.

During one portion of the operating cycle of the printer in which the fuser is utilized, it is controlled to an average power level of 2700 watts over a 1.25 second period of operation. A 1.25 second period represents twenty-five, 50 msec segments that are used to average the fuser power to the specified level. This is effected by normalizing the input voltage to an average of 179 VAC by deleting one or more of the twenty-five, 50 msec. Thus, 50 msec segments are removed as required depending on the input voltage to produce an average power of 2700 watts. For a continuously applied voltage of 179 VAC the heater element 14 would be operated in a full-on mode. When the applied voltage exceeds the 179 VAC one or more 50 msec segments are removed or not used. For example, at 182 VAC, one 50 msec segment out of the twenty-five is removed. At 185 VAC, two such segments are removed. At 188 VAC, three 50 msec segments are removed and at 191 VAC, four 50 msec segments are removed. These voltages and their corresponding operating parameters are stored in a Look Up Table (LUT) in a Printed Wire Board Assembly (PWBA) 40 shown in FIG. 2. A detected voltage signal 42 is fed to the PWBA along with an elapsed time signal 44 which are processed for generating an output to a Solid State Relay (SSR) 46 used for controlling the operation of the heating element 14. The signals 42 and 44 are outputted to the SSR via gate 47.

A partial list of the values stored in the LUT are as follows:

| Detected Voltage | Heater Element Operating parameters |
|---|---|
| 179 VAC | Full-On (Twenty-five, 50 msec segments out of a possible 25 are used). |
| 182 VAC | One 50 msec segment is not used. |
| 185 VAC | Two 50 msec segments are not used. |
| 188 VAC | Three 50 msec segments are not used |

Pursuant to the objects of the present invention, the existing hardware and LUT are utilized to control the fusing element at an average power of about 3000 watts during the initial portion of the print cycle to compensate for the sag phenomena. This is done for the first 20 seconds of a print run by subtracting 9 VAC from the read or detected voltage. After the first 20 seconds has elapsed, the voltage read is decreased by 5 VAC RMS until 40 seconds has elapsed and then 3 VAC is subtracted until 60 seconds of run has been reached after which the fuser element is run at the read VAC. The voltages are subtracted because the fuser element is being turned on for longer periods of time at the lower voltages which means that watts are being added. This type of control will add 350 watts of power in the first 20 seconds of operation and gradually reduce the average wattage to 2700 watts over longer runs without changing elements.

As an example, for a fuser running at 191 VAC during the first 20 seconds of print the fuser is controlled at the 183 VAC level. This would add 12% to the average wattage. From 21 to 40 seconds of run, the fuser is run at 185 VAC adding 8% the average wattage. From 40 to 60 seconds of print, the fuser is controlled at the 188 VAC level adding 4% average power. From 60 seconds on, the fuser is run at the read value in this case 191 VAC. Each time the IOT started up the sequence would be the same for the first 60 seconds of operation thereby eliminating the sag problem. Pursuant to the invention, a heater element is operated at a higher power level during the initial portion of a print cycle. This is effected using an existing controller without modifying the controller's hardware.

In summary, during a steady state portion of a print cycle, the fuser controller is operated according to the parameters found in the LUT as set forth above. Operation in this manner has the of effect of normalizing the heater element input voltage to an average level of 179 VAC which produces an average power level of 2700 watts. During the initial portion of the print cycle the same LUT values are still used but in order to boost the average power level of the heater element to about 3000 watts to compensate for sag the operating parameters for the detected voltage during this portion of the print cycle correspond to the operating parameters for a voltage lower than the detected voltage. Thus, the LUT is used for controlling the heater element during both portions of the print cycle but different operating parameters are used for a detected voltage.

What is claimed is:

1. A method of controlling the operation of a heated fuser member, said method including the steps of:

detecting voltages applied to said heated fuser member;

detecting elapsed time in a print cycle of a printer in which said heated fuser member is utilized;

storing voltage values and corresponding fuser operating parameters;

using operating parameters corresponding to a detected voltage for controlling operation of said heated fuser member during one portion of said print cycle in accordance with elapsed time; and determining the difference between a detected voltage and a predetermined voltage value and using the fuser operating parameters corresponding to said difference for controlling operation of said fuser member during another portion of said print cycle in accordance with elapsed time.

2. The method according to claim 1 wherein said step of controlling operation of said heated fuser member during said one portion of said print cycle and said another portion of said print cycle are at different power levels.

3. The method according to claim 2 wherein operation of said heated fuser member is at a higher power level during said another portion of said print cycle.

4. The method according to claim 3 wherein said step of storing comprises storing in a LUT in computer memory.

5. The method according to claim 4 wherein said higher power level is about 3000 watts.

6. The method according to claim 5 wherein the power level during said one portion of said print cycle is about 2700 watts.

7. The method according to claim 6 said power level of 2700 watts is effected by normalizing the input voltage to said heated fuser member to about 179 VAC.

8. The method according to claim 7 wherein power is supplied continuously to said heated fuser member during said one portion of said print cycle when said detected voltage is a predetermined value.

9. The method according to claim 8 wherein during said one portion of said print cycle power is not continuously supplied to said heated fuser member during said one portion of said print cycle when said detected voltage is greater than said predetermined value.

10. The method according to claim 9 wherein during said one portion of said print cycle when said detected voltage is greater than said predetermined value supply of power to said heated fuser member is discontinued for one or more predetermined time periods.

11. Apparatus for controlling the operation of a heated fuser member, said apparatus comprising:

means for detecting voltages applied to said heated fuser member;

means for detecting elapsed time in a print cycle of a printer in which said heated fuser member is utilized;

means for storing voltage values and corresponding fuser operating parameters;

means for effecting use of operating parameters corresponding to a detected voltage for controlling operation of said heated fuser member during one portion of said print cycle in accordance with elapsed time; and means for determining the difference between a detected voltage and a predetermined voltage value and using the fuser operating parameters corresponding to said difference for controlling operation of said fuser member during another portion of said print cycle in accordance with elapsed time.

12. Apparatus according to claim 11 wherein said means for effecting use of operating parameters during said one portion of said print cycle and during said another portion of said print cycle are are at different power levels.

13. Apparatus according to claim 12 wherein operation of said heated fuser member is at a higher power level during said another portion of said print cycle.

14. Apparatus according to claim 13 wherein said means for storing comprises means for storing in a LUT in computer memory.

15. Apparatus according to claim 14 wherein said higher power level is about 3000 watts.

16. Apparatus according to claim 15 wherein the power level during said one portion of said print cycle is about 2700 watts.

17. Apparatus according to claim 16 said power level of 2700 watts is effected by normalizing the input voltage to said heated fuser member to about 179 VAC.

18. Apparatus according to claim 17 wherein power is supplied continuously to said heated fuser member during said one portion of said print cycle when said detected voltage is a predetermined value.

19. Apparatus according to claim 18 wherein during said one portion of said print cycle power is not continuously supplied to said heated fuser member during said one portion of said print cycle when said detected voltage is greater than said predetermined value.

20. Apparatus according to claim 19 wherein during said one portion of said print cycle when said detected voltage is greater than said predetermined value supply of power to said heated fuser member is discontinued for one or more predetermined time periods.

* * * * *